US005727703A

United States Patent [19]

Fuchs

[11] Patent Number: 5,727,703

[45] Date of Patent: Mar. 17, 1998

[54] CHILD RESISTANT PACKAGE UTILIZING ONE PIECE CLOSURE

[75] Inventor: Timothy J. Fuchs, Perrysburg, Ohio

[73] Assignee: Owens-Illinois Closure Inc., Toledo, Ohio

[21] Appl. No.: 641,978

[22] Filed: May 1, 1996

[51] Int. Cl.[6] ..... B65D 55/02

[52] U.S. Cl. ..... 215/214; 215/216

[58] Field of Search ..... 215/211, 214, 215/216, 217, 221, 330, 331

[56] References Cited

U.S. PATENT DOCUMENTS

| | | | |
|---|---|---|---|
| 3,445,022 | 5/1969 | Cilluffo . | |
| 4,036,385 | 7/1977 | Morris . | |
| 4,103,797 | 8/1978 | Morris | 215/209 |
| 4,572,385 | 2/1986 | Luker | 215/216 |
| 4,865,209 | 9/1989 | Bush | 215/216 |
| 5,078,288 | 1/1992 | Fuchs . | |
| 5,174,465 | 12/1992 | Luch et al. . | |
| 5,230,433 | 7/1993 | Hamilton et al. . | |
| 5,383,564 | 1/1995 | Hamilton et al. . | |
| 5,460,281 | 10/1995 | Rapchak et al. . | |
| 5,462,182 | 10/1995 | Opresco | 215/216 |

*Primary Examiner*—Stephen Cronin

[57] ABSTRACT

A child resistant package including a plastic container having a body portion and a finish with internal threads. The plastic container has a radial flange extending outwardly from the finish and an upwardly extending axial wall extending axially upwardly from the periphery of the radial flange. The axial wall has at least one lug extending radially inwardly from the axial wall. A plastic closure has a base wall and a peripheral skirt having external threads engaging said internal threads on the container. The closure has a radial flange engaging the radial flange on the finish when the closure is threaded on the finish and a finger engaging tab thereon having a flexible portion which engages the lug on the container when the closure is fully threaded on the finish to prevent the closure from being removed. Radial inward deflection of the tab permits the closure to be rotated past the lug in order to remove the closure from the container.

9 Claims, 2 Drawing Sheets

CHILD RESISTANT PACKAGE UTILIZING ONE PIECE CLOSURE

This invention relates to child resistant packages and particularly to child resistant packages wherein the closure has external threads engaging internal threads on the container.

BACKGROUND AND SUMMARY OF THE INVENTION

One type of child resistant package such as shown in U.S. Pat. No. 5,078,288 there is disclosed a plastic container having a neck or finish with internal threads that are engaged by external threads on a closure. The finish of the container includes an axially extending flexible wall and interengaging ratchets are provided between a flange on the closure and the flexible wall on the container and are operable to permit rotation of the closure to apply the closure to the container but prevent rotation of the closure for removing the closure from the container. When the flexible wall is flexed at points spaced from the ratchet, the wall is deformed sufficiently to prevent the ratchets on the wall and the closure from engaging so that the closure can be rotated to remove the closure from the container.

Among the objectives of the present invention are to provide a child resistant package which requires depression of the finger of the user to permit the closure to be removed; wherein the package eliminates any need for a flexible portion on the container; and wherein the child resistant package inches in one form a spout on the container.

DESCRIPTION OF THE PREFERRED EMBODIMENT

Figure 1:
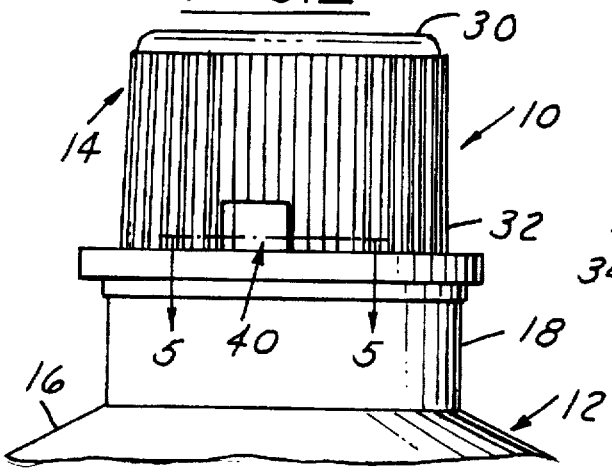
FIG. 1 is a fragmentary elevational view of the child resistant package embodying the invention.
Figure 4:
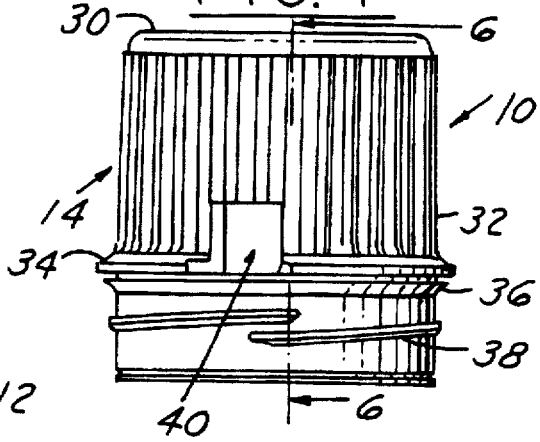
FIG. 4 is an elevational view of the closure that forms part of the package.
Figure 5:
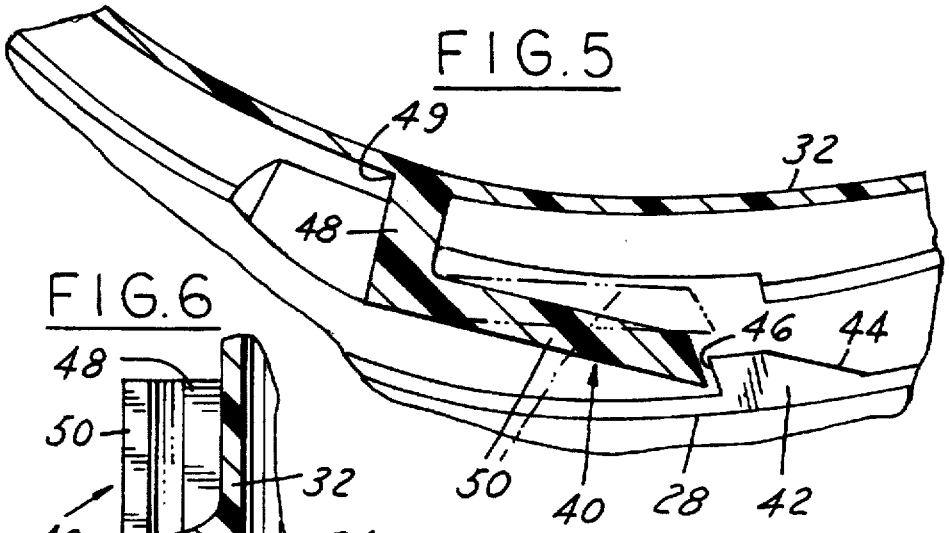
FIG. 5 is a section view on an enlarged scale taken along the line 5—5 in FIG. 1.
Figure 6:
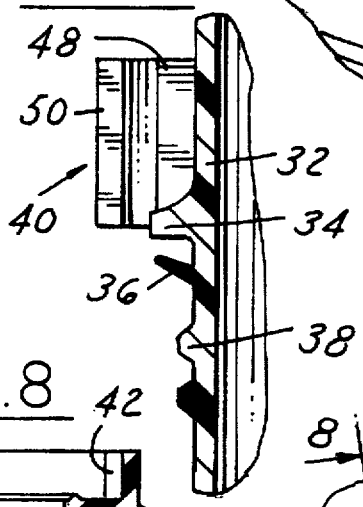
FIG. 6 is a sectional view on an enlarged scale taken along the line 6—6 in FIG. 4.

Referring to FIGS. 1–8, the child resistant package 10 embodying the invention comprises a plastic container 12 and a plastic closure 14. The plastic container 12 includes a body portion 16 and a finish 18 having internal threads 20. In the preferred form the container 12 includes an integral spout 22 extending axially through the finish 18 and having a drain back opening 24. The container includes an integral radial wall 26 extending radially outwardly from the upper end of the finish 18 above the threads 20. In addition the container 12 includes an integral relatively rigid axial wall 28 extending axially upwardly from the periphery of the radial wall 26.

The plastic closure 14 includes a base wall 30 and a peripheral skirt 32 with an integral radial flange 34 adapted to engage the upper end of the finish 18 of the container 12 and a seal in the form of an integral annular lip 36 which engages the inner surface of the finish 18. Closure 14 includes external threads 38 which interengage the threads 20 on the finish 18.

Figure 8:
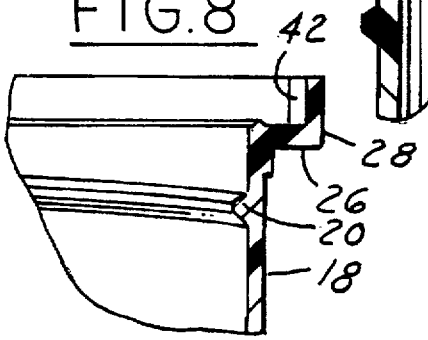
FIG. 8 is a fragmentary sectional view taken along the line 8—8 in FIG. 7.
Figure 7:
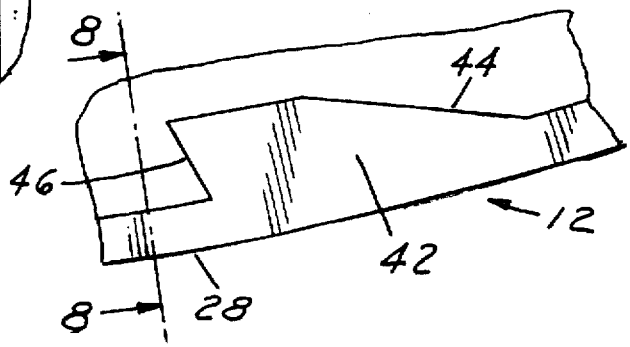
FIG. 7 is a fragmentary top plan view on an enlarged scale of a portion of the container.
Figure 2:
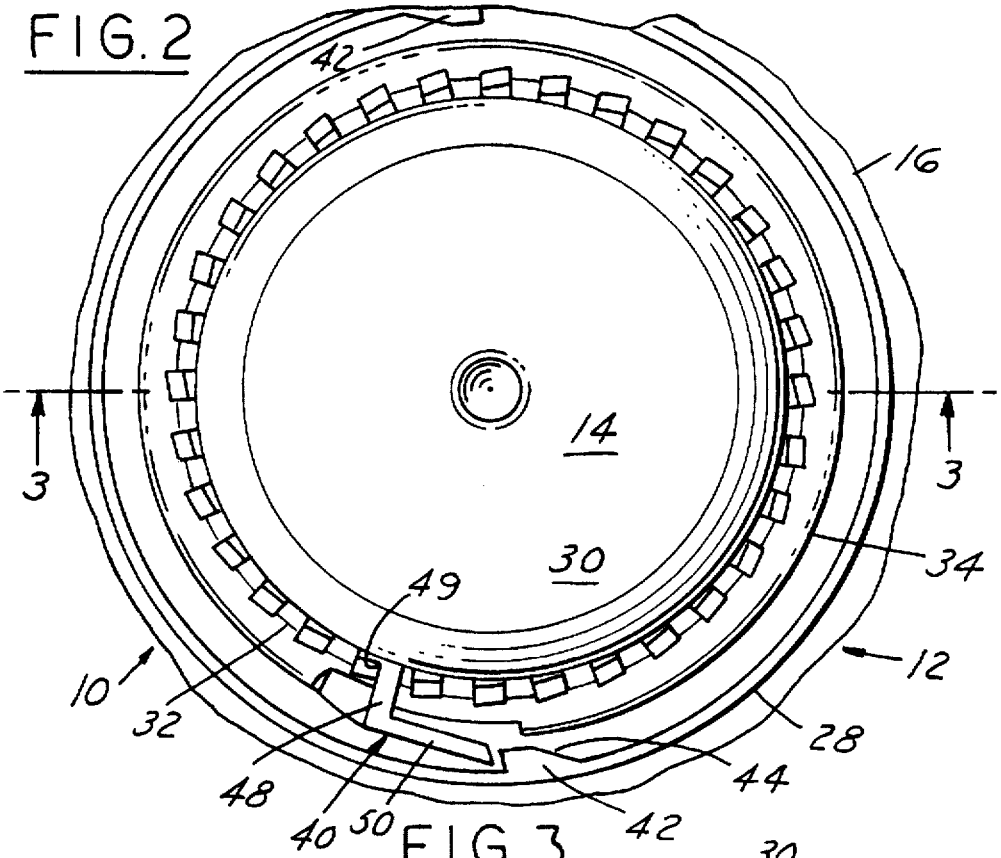
FIG. 2 is an enlarged top plan view of the package.
Figure 3:
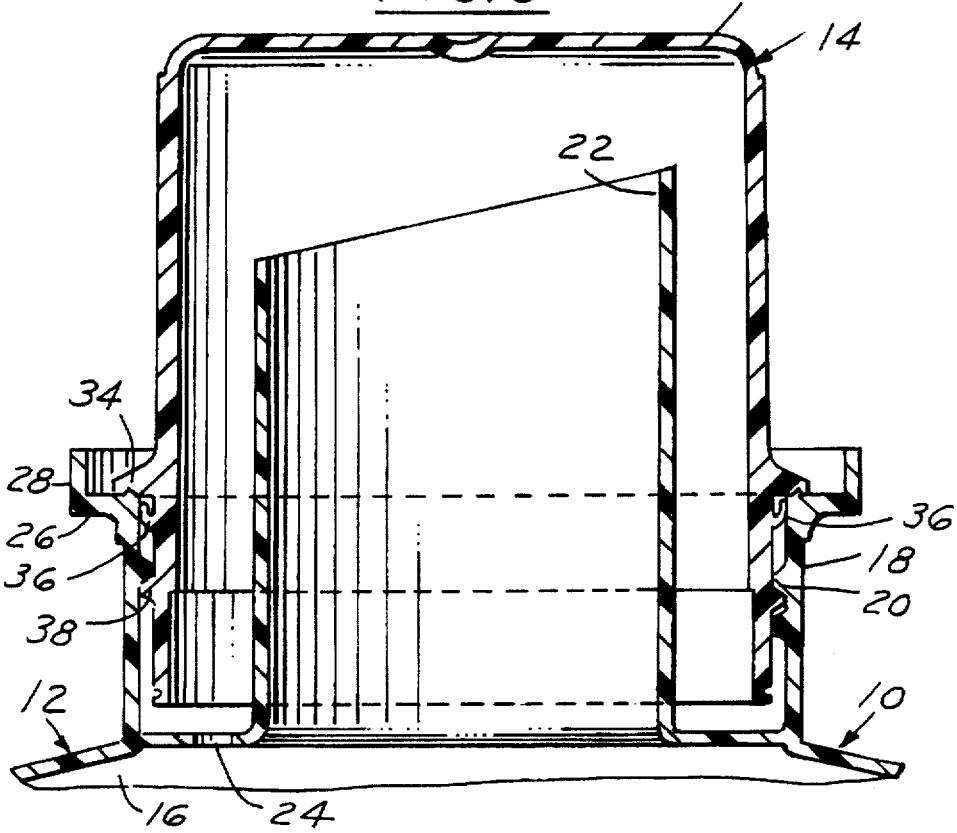
FIG. 3 is a sectional view taken along the line 3—3 in FIG. 2.

The closure 14 further includes an integral flexible finger engaging tab 40 which engages an integral lug 42 on the inner surface of the axial wall 28 of the container. When the closure 14 is threaded onto the container 12 the tab 40 flexes past the lug 42 to prevent rotation of the closure 14 in a direction to remove the closure 14. As shown in FIGS. 7 and 8, the lug 42 includes an inwardly inclined vertical surface 44 and a stop surface 46 which is at an acute angle to a vertical plane to facilitate application of the closure 14 and locking of the closure 14 in sealing position on the container 12. Preferably, two diametrically opposed lugs 42 are provided such that when the closure and container have double threads, the closure can be applied in two positions and one of the lugs 42 will engage tab 40.

Referring to FIGS. 1, 2, and 4–6, the finger engaging tab 40 is preferably hinged at one end 49 along a axis that extends vertically of the axis of the closure 14. Tab 40 extends circumferentially in a direction opposite to the direction of rotation of the closure 14 for application of the closure 14 to the container 12. Preferably the tab 40 is L-shaped and includes a rigid radial portion 48 and a flexible circumferential portion 50. Radial portion 48 extends from the skirt 32 and is also integral with the radial flange 34.

The plastic container is blow molded and may be made of plastic such as polypropylene or polyethylene. The closure is made of plastic such a polypropylene.

It can thus be seen that there has been provided a child resistant package which requires depression of the finger of the user to permit the closure to be removed; wherein the package eliminates any need for a flexible portion on the container; and wherein the child resistant package includes in one form a spout on the container.

I claim:

1. A child resistant package comprising a plastic container having a body portion and a finish with internal threads, said plastic container including a radial flange extending outwardly from said finish and an upwardly extending rigid axial wall extending axially upwardly from the periphery of said radial flange, said axial wall having at least on lug extending radially inwardly from the axial wall, a plastic closure comprising a base wall and a peripheral skirt having external threads engaging said internal threads on said container, said closure having a radial flange engaging said radial flange on the finish when the closure is threaded on the finish, said finger engaging pad being hinged at one end for movement about an axis extending generally vertically of the axis of said closure and extending circumferentially in a direction opposite to the direction of rotation of said closure for application of said closure and having a free edge which engages said lug on the container when the closure is fully threaded on the finish to prevent the closure from being removed, said tab upon radial inward deflection permitting the closure to be rotated past the lug in order to remove the closure from the container.

2. The child resistant package set forth in claim 1 wherein said tab is generally L-shaped and includes a first portion extending radially outwardly from said skirt and a second portion extending circumferentially.

3. The child resistant package set forth in claim 2 wherein said radial portion of said tab is integral with said skirt and the flange of the closure.

4. The child resistant package set forth in claim 3 wherein said lug includes a radially inwardly inclined vertical surface engaged by said first portion of said tab upon application of the closure to said container and a second vertical surface defining a stop surface at an acute angle to a vertical plane engaged by the free edge of the flexible portion when the closure is fully applied on the container.

5. The child resistant package set forth in claim 4 wherein said container includes two diametrically opposed lugs and said container and said closure having double thread.

6. The child resistant package set forth in any one of claims 1–5 wherein said container includes an integral spout portion having a drain back opening extending within said finish.

7. The closure set forth in claim 6 wherein said tab is generally L-shaped and includes a first portion extending radially outwardly from said skirt and a second portion extending circumferentially.

8. The closure set forth in claim 7 wherein said radial portion of said tab is integral with said skirt and the flange of the closure.

9. For use in a child resistant package comprising a plastic container having a body portion and a finish with internal threads, said plastic container including a radial flange extending outwardly from said finish and an upwardly extending axial wall extending axially upwardly from the periphery of said radial flange, said axial wall having at least on lug extending radially inwardly from the axial wall, a plastic closure comprising a base wall and a peripheral skirt having external threads adapted to engage said internal threads on said container, said closure having a radial flange adapted to engage said radial flange on the finish when the closure is threaded on the finish, said finger engaging pad being hinged at one end for movement about an axis extending generally vertically of the axis of said closure and extending circumferentially in a direction opposite to the direction of rotation of said closure for application of said closure and having a free edge which is adapted to engage said lug on the container when the closure is fully threaded on the finish to prevent the closure from being removed, said tab upon radial inward deflection permitting the closure to be rotated past the lug in order to remove the closure from the container.

* * * * *